US011644786B2

(12) United States Patent
Kurosu et al.

(10) Patent No.: US 11,644,786 B2
(45) Date of Patent: May 9, 2023

(54) IMAGE FORMING APPARATUS

(71) Applicant: CANON KABUSHIKI KAISHA, Tokyo (JP)

(72) Inventors: Yuki Kurosu, Chiba (JP); Yuichi Tanabe, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/720,874

(22) Filed: Apr. 14, 2022

(65) Prior Publication Data

US 2022/0342356 A1 Oct. 27, 2022

(30) Foreign Application Priority Data

Apr. 26, 2021 (JP) ..... JP2021-073856
Mar. 9, 2022 (JP) ..... JP2022-036137

(51) Int. Cl.
*G03G 15/00* (2006.01)

(52) U.S. Cl.
CPC ..... *G03G 15/757* (2013.01)

(58) Field of Classification Search
CPC ..... G03G 15/757
See application file for complete search history.

(56) References Cited

U.S. PATENT DOCUMENTS 8,229,324 B2 7/2012 Takigawa et al. ..... G03G 15/00
2007/0189805 A1* 8/2007 Takigawa ..... G03G 15/757 399/167
2015/0037071 A1 2/2015 Yamamoto ..... G03G 15/08
2015/0346679 A1 12/2015 Kusano et al. ..... G03G 15/00
2016/0274530 A1 9/2016 Tanabe et al. ..... G03G 21/1619
(Continued)

FOREIGN PATENT DOCUMENTS

JP 2007-155072 6/2007
JP 2008-184232 8/2008
JP 2015-219449 12/2015
(Continued)

OTHER PUBLICATIONS

Office Action dated Nov. 9, 2022 in counterpart India Application No. 202244024139, together with English translation thereof.
(Continued)

*Primary Examiner* — Sevan A Aydin
(74) *Attorney, Agent, or Firm* — Venable LLP

(57) ABSTRACT

An image forming apparatus includes a driving unit including a driving source, a drive gear, a first support member that holds the driving source and includes a first support portion that supports one end portion of a rotation shaft of the drive gear, and a second support member that includes a second support portion that supports another end portion of the rotating shaft. The first support member includes a fastening hole disposed in a projection plane obtained by projecting the second support portion in the rotation axis direction of the drive gear. The second support member is disposed upstream of the first support member in a fastening direction, and includes a mounting portion extending so as to be in contact with the first support portion in the projection plane, the mounting portion including an attachment hole, the attachment hole being disposed at a position overlapping the fastening hole.

13 Claims, 9 Drawing Sheets

(56) References Cited

U.S. PATENT DOCUMENTS

| | | | | |
|---|---|---|---|---|
| 2022/0187757 | A1 | 6/2022 | Tanabe et al. | G03G 21/186 |

FOREIGN PATENT DOCUMENTS

| | | | | | |
|---|---|---|---|---|---|
| JP | 2016-102885 | | | 6/2016 | |
| JP | 2016177164 | A | * | 10/2016 | G03G 21/1619 |
| JP | 6207284 | B2 | | 10/2017 | |
| JP | 2018-120076 | | | 8/2018 | |
| JP | 6544982 | B2 | | 7/2019 | |

OTHER PUBLICATIONS

U.S. Appl. No. 17/724,211, filed Apr. 19, 2022.

* cited by examiner

IMAGE FORMING APPARATUS

BACKGROUND OF THE INVENTION

Field of the Invention

The present invention relates to an image forming apparatus using electrophotography, such as a printer, a copier, a facsimile, or a multifunction peripheral.

Description of the Related Art

In an image forming apparatus such as a printer, a copier, a facsimile, or a multifunction peripheral in which these are integrally combined, for example, a photosensitive drum, a developing sleeve, a driving roller for rotating an intermediate transfer belt, and the like are provided in an apparatus body as a rotating member. Conventionally, in order to drive these rotating members, a driving unit in which motors and drive gears are integrated is attached to a rear plate of an apparatus body. As an example, for example, there has been proposed a driving unit including two support plates that are arranged at both ends of a drive gear in a rotation axis direction and support a rotation shaft of the drive gear, and the drive gear is arranged in a space sandwiched between the support plates (JP 2007-155072 A).

In the driving unit described in JP 2007-155072 A, two support plates are connected to each other via a cover member that closes a gap therebetween. That is, when foreign matter such as dust enters the space where the drive gear is disposed from the outside and adheres to the drive gear, rotational fluctuation occurs in the rotating member driven by the driving unit, and image defects such as periodic band-shaped density unevenness (referred to as banding or the like) may occur in the image formed on the recording material. In addition, when foreign matter adhering to the drive gear is caught in the drive gear, abnormal noise occurs. Therefore, in order to prevent foreign matter from entering from the outside, a cover member that closes a gap between the two support plates is installed.

Incidentally, for example, in a case where two support plates are connected using a screw, foreign matter such as metal powder generated by fastening of the screw may adhere to the drive gear. That is, although the support plate is perforated in advance with a fastening hole for fastening a screw, metal powder, which is generated when the support plate is scraped and perforated, may remain in the fastening hole as scraping powder. Conventionally, since a screw is inserted and fastened from the outside toward the inside (space side) of the support plate, the metal powder is pushed inward from the fastening hole by the screw and adheres to the drive gear inside, which is arranged in advance. Alternatively, in a case where the screw is fastened while tapping is performed, metal powder generated by the tapping is pushed inward, and may adhere to the drive gear. The metal powder adhered to the drive gear causes the above-described image defect and abnormal noise similarly to foreign matter such as dust entering from the outside.

Therefore, in order to prevent the metal powder generated by the fastening of the screw from adhering to the drive gear, it is conceivable to provide a fastening region in which a fastening hole is formed on the outer peripheries of the two support plates when viewed from the rotation axis direction of the drive gear and to fasten the screw thereto. With such a configuration, the metal powder which may be generated by fastening the screw falls not to the inside (space side) but to the outside of the support plate. Therefore, it is possible to prevent the metal powder from adhering to the drive gear. However, when a fastening region is newly secured in the support plate, the driving unit has to be increased in size, and accordingly, it is difficult to adopt the driving unit because this goes against the recent demand for miniaturization as an image forming apparatus.

Therefore, it has been conventionally desired to suppress the occurrence of image defects and abnormal noise due to the adhesion of foreign matter to the drive gear caused by the fastening of the screw in the driving unit without increasing the size of the driving unit, but such a configuration has not been proposed yet.

The present invention has been made in view of the above problems, and the present invention provides an image forming apparatus that suppresses occurrence of image defects and abnormal noise due to adhesion of foreign matter to a drive gear, the foreign matter occurring due to fastening of a screw in the driving unit, without increasing the size of the driving unit.

SUMMARY OF THE INVENTION

According to a first aspect of the present invention is an image forming apparatus that forms an image on a recording material, the image forming apparatus including a rotating member, and a driving unit configured to drive the rotating member. The driving unit includes a driving source, a drive gear configured to transmit a driving force of the driving source to the rotating member, a first support member that holds the driving source and includes a first support portion that supports one end portion of a rotation shaft of the drive gear in a rotation axis direction of the drive gear, and a second support member that includes a second support portion that supports another end portion of the rotating shaft and is connected to the first support member by a fastening member. The first support member includes a fastening hole to which the fastening member is fastened, the fastening hole being disposed in a projection plane obtained by projecting the second support portion in a rotation axis direction of the drive gear. The second support member is disposed upstream of the first support member in a fastening direction in which the fastening member is fastened, and includes a mounting portion extending from the second support portion downstream in the fastening direction so as to be in contact with the first support portion in the projection plane, the mounting portion including an attachment hole into which the fastening member is inserted, the attachment hole being disposed at a position overlapping the fastening hole in a contact portion of the mounting portion which is in contact with the first support portion.

According to a second aspect of the present invention is an image forming apparatus that forms an image on a recording material, the image forming apparatus including a rotating member, and a driving unit configured to drive the rotating member. The driving unit includes a driving source, a drive gear configured to transmit a driving force of the driving source to the rotating member, a first support member that holds the driving source and includes a first support portion that supports one end portion of a rotation shaft of the drive gear in a rotation axis direction of the drive gear, and a second support member that includes a second support portion that supports another end portion of the rotating shaft and is connected to the first support member by a fastening member. The first support member includes a fastening hole to which the fastening member is fastened and that is disposed in a projection plane obtained by projecting the second support portion in a rotation axis direction of the drive gear. The second support member is disposed upstream of the first support member in a fastening direction in which the fastening member is fastened, and includes a flange portion extending from the second support portion downstream in the fastening direction in the projection plane, the flange portion including an attachment hole into which the fastening member is inserted, the attachment hole being disposed at a position overlapping the fastening hole.

Further features of the present invention will become apparent from the following description of exemplary embodiments with reference to the attached drawings.

BRIEF DESCRIPTION OF THE DRAWINGS

FIGS. 7A and 7B are views for explaining metal powder generated by fastening of a screw, in which FIG. 7A illustrates a state before inserting the screw into a fastening hole, and FIG. 7B illustrates a state after inserting the screw into the fastening hole.

FIGS. 9A and 9B are schematic views illustrating a comparative example, in which FIG. 9A illustrates a case where a screw is fastened from the sub support member side toward the main support member side, and FIG. 9B illustrates a case where a screw is fastened from the main support member side toward the sub support member side.

DESCRIPTION OF THE EMBODIMENTS

Image Forming Apparatus

Figure 1:
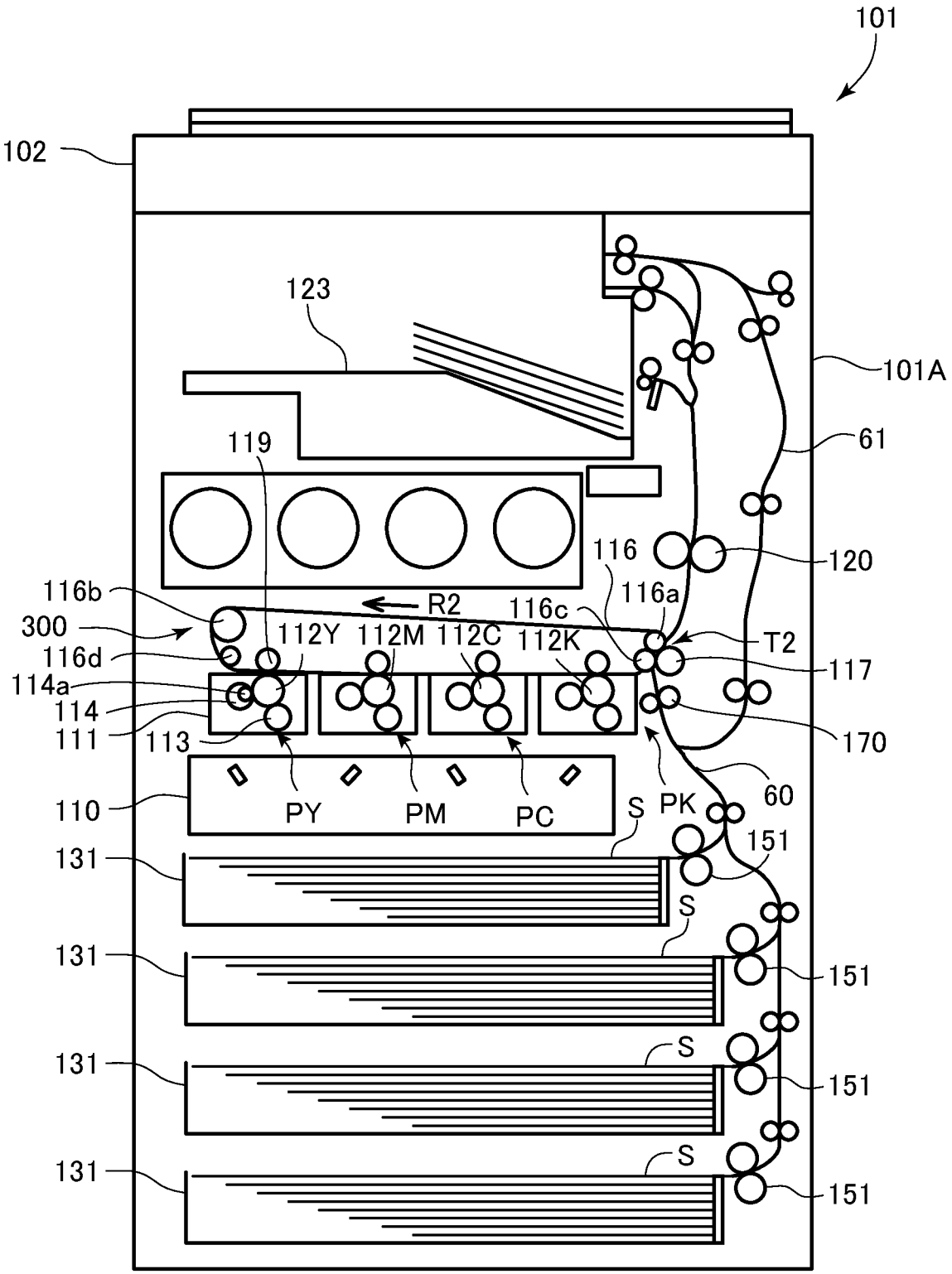
FIG. 1 is a schematic diagram illustrating a configuration of an image forming apparatus according to a present embodiment.

An image forming apparatus according to the present embodiment will be described with reference to FIG. 1. The image forming apparatus 101 illustrated in FIG. 1 is an intermediate transfer full-color printer. The image forming apparatus 101 includes image forming units PY, PM, PC, and PK that form yellow, magenta, cyan, and black toner images, respectively. The image forming apparatus 101 forms a toner image on the recording material S according to an image signal from a document reading apparatus 102 provided above the image forming apparatus 101 in the vertical direction or an external device (not illustrated) such as a personal computer. Examples of the recording material S include sheet materials such as paper, a plastic film, and cloth. In the present specification, a side on which a user stands when operating an operation panel (not illustrated) in order to operate the image forming apparatus 101 is referred to as a "front surface", and the opposite side is referred to as a "back surface".

In the image forming apparatus 101 illustrated in FIG. 1, the image forming units PY, PM, PC, and PK are arranged side by side along the moving direction (direction of arrow R2) of the intermediate transfer belt 116. The intermediate transfer belt 116 is an endless belt member that carries and conveys the toner images primarily transferred from the photosensitive drums 112Y, 112M, 112C, and 112K of the image forming units PY, PM, PC, and PK. The intermediate transfer belt 116 is stretched around each rotating member of a secondary transfer inner roller 116*a*, a tension roller 116*b*, a pre-secondary transfer roller 116*c*, and a stretching roller 116*d*. Then, the intermediate transfer belt 116 is moved in the moving direction by a secondary transfer inner roller 116*a* (rotating member, secondary transfer roller) rotationally driven by a driving unit 90 (see FIG. 2) to be described later. That is, in the present embodiment, the secondary transfer inner roller 116*a* also serves as a driving roller that drives the intermediate transfer belt 116.

The image forming apparatus 101 includes a support frame member 101A that supports units such as the photosensitive drums 112Y to 112K, the secondary transfer inner roller 116*a*, the tension roller 116*b*, the pre-secondary transfer roller 116*c*, and the stretching roller 116*d*. The support frame member 101A includes a plurality of sheet metals such as a front plate provided on the front side of the image forming apparatus 101, a rear plate provided on the back side and supporting each unit together with the front plate, a stay connecting the front plate and the rear plate, and a support column supporting the front plate, and is covered with an exterior cover (not illustrated) constituting the external appearance of the image forming apparatus 101.

A secondary transfer outer roller 117 is disposed so as to sandwich the secondary transfer inner roller 116*a* and the intermediate transfer belt 116, and forms a secondary transfer nip portion T2 for transferring the toner image on the intermediate transfer belt 116 to the recording material S. In the secondary transfer nip portion T2, the secondary transfer inner roller 116*a* and the secondary transfer outer roller 117 rotate to nip and convey the recording material S.

Under the image forming apparatus 101, one or a plurality of cassettes 131 in which the recording material S is accommodated are arranged. The recording materials S accommodated in the cassette 131 are supplied one by one from the cassette 131 to the conveyance path 60 in accordance with the image forming timing by the feed roller 151. The recording material S is conveyed to a registration roller 170 disposed on the conveyance path 60, skew correction and timing correction are performed by the registration roller 170, and the recording material S is conveyed toward the secondary transfer nip portion T2. The cassette 131 is slidably supported with respect to the support frame member 101A. The user can refill the cassette 131 with the recording material S by pulling out the cassette 131 to the front side of the image forming apparatus 101.

The four image forming units PY, PM, PC, and PK included in the image forming apparatus 101 have substantially the same configuration except that the colors of the toners used in developing units 114 included therein are different. Therefore, here, the yellow image forming unit PY will be representatively described, and description of the other image forming units PM, PC, and PK will be omitted.

In the image forming unit PY, the photosensitive drum 112Y is disposed as one of the rotating members. The photosensitive drum 112Y is rotationally driven by the driving unit 90 (see FIG. 2) to be described later. A charging unit 113, a developing unit 114, and a primary transfer roller 119 are disposed around the photosensitive drum 112Y.

When the image forming operation is started, first, the surface of the rotating photosensitive drum 112Y is uniformly charged by the charging unit 113. Next, the photosensitive drum 112Y is scanned and exposed by laser light emitted from the exposing unit 110 shared by the image forming units PY to PK. As a result, an electrostatic latent image corresponding to the image signal is formed on the photosensitive drum 112Y. The electrostatic latent image on the photosensitive drum 112Y is developed by toner (developer) in the developing unit 114, and a toner image is formed on the photosensitive drum 112Y. The developing unit 114 includes a conveying screw (not illustrated) that circularly conveys the developer in the developer container, a developing sleeve 114*a* (rotating member) that carries the developer and rotates to develop the toner image on the photosensitive drum 112Y, and the like. The developing sleeve 114*a* is driven by the driving unit 90 (see FIG. 2) to be described later.

The toner image formed on the photosensitive drum 112Y is primarily transferred from the photosensitive drum 112Y to the intermediate transfer belt 116 at a primary transfer portion formed between the photosensitive drum 112Y and the primary transfer roller 119 disposed across the intermediate transfer belt 116. At this time, a primary transfer voltage is applied to the rotating primary transfer roller 119. Thus, the intermediate transfer belt 116 is rotated while carrying the toner image transferred from the photosensitive drum 112Y.

By sequentially performing the above-described operation in the yellow, magenta, cyan, and black image forming units PY to PK, a toner image can be formed on the intermediate transfer belt 116. For example, a toner image of a single color can be formed, or a toner image of a desired color can be formed by appropriately superimposing some of the four colors. In accordance with the toner image forming timing, the recording material S supplied from the cassette 131 is conveyed to the secondary transfer nip portion T2 via the registration roller 170. Then, for example, when a secondary transfer voltage is applied to the secondary transfer outer roller 117 by a high-voltage power supply (not illustrated), the toner image on the intermediate transfer belt 116 is secondarily transferred to the recording material S when the recording material S passes through the secondary transfer nip portion T2.

The recording material S to which the toner image has been transferred from the intermediate transfer belt 116 is conveyed to the fixing unit 120. The fixing unit 120 applies heat and pressure to the recording material S while nipping and conveying the recording material S to fix the toner image on the recording material S. In the case of single-sided printing mode in which a toner image is formed only on one side of the recording material S, the recording material S on which the toner image is fixed by the fixing unit 120 is discharged to a recording material discharge unit 123. On the other hand, in the case of double-sided printing mode in which toner images are formed on both surfaces of the recording material S, after the toner image is fixed on one surface by the fixing unit 120, the recording material S is reversed by switchback conveyance, and is conveyed toward the registration roller 170 through a duplex conveyance path 61. Thereafter, the recording material S undergoes a process similar to that in the case of the single-sided printing mode, a toner image is also formed on the other surface by the fixing unit 120, and then the recording material S is discharged to the recording material discharge unit 123.

In the case of the present embodiment, the intermediate transfer belt 116, the secondary transfer inner roller 116*a*, the tension roller 116*b*, the pre-secondary transfer roller 116*c*, the stretching roller 116*d*, and the plurality of primary transfer rollers 119 described above form an intermediate transfer unit 300.

Note that, the image forming apparatus 101 can form not only a multicolor image but also a black monochrome image using only the image forming unit PK. In the case of forming a black monochrome image, primary transfer rollers 119 transferring a toner image of a color other than black are separated from the intermediate transfer belt 116 by a primary transfer roller separation mechanism (not illustrated) driven by the driving unit 90 (see FIG. 2) to be described later.

Outline of Driving Unit

In the image forming apparatus 101 of the present embodiment, a driving unit 90 is provided in order to drive the photosensitive drums 112Y to 112K, the secondary transfer inner roller 116*a*, the primary transfer roller separating mechanism (not illustrated), and the developing unit 114 (specifically, the developing sleeve 114*a*). An outline of the driving unit 90 will be described with reference to FIGS. 2 to 4 while referring to FIG. 1.

As will be described in detail later, the driving unit 90 includes a main support member 20 as a first support member and a sub support member 25 (see FIG. 4) as a second support member which are formed of, for example, a thin sheet metal. In the present embodiment, the driving unit 90 is fixed not inside the support frame member 101A of the image forming apparatus 101 but outside the support frame member 101A. Here, the outside of the support frame member 101A refers to a side surface covered by the above-described exterior cover. Therefore, since the driving unit 90 can be accessed by removing the exterior cover of the image forming apparatus 101, it is configured to be easier to perform maintenance than a configuration in which the driving unit is fixed to the inside of the support frame member 101A.

Figure 2:
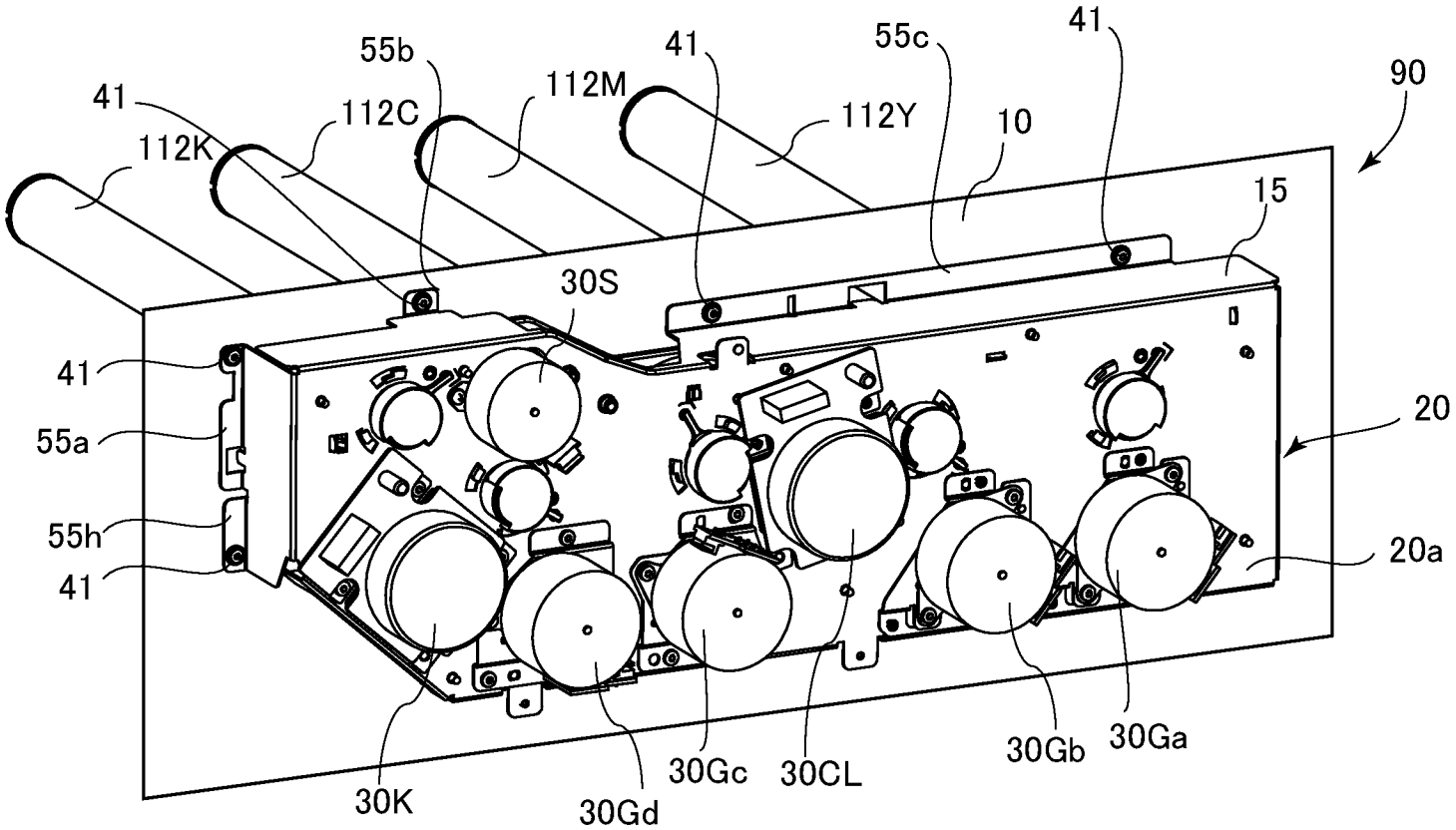
FIG. 2 is a perspective view illustrating a driving unit.
Figure 3:
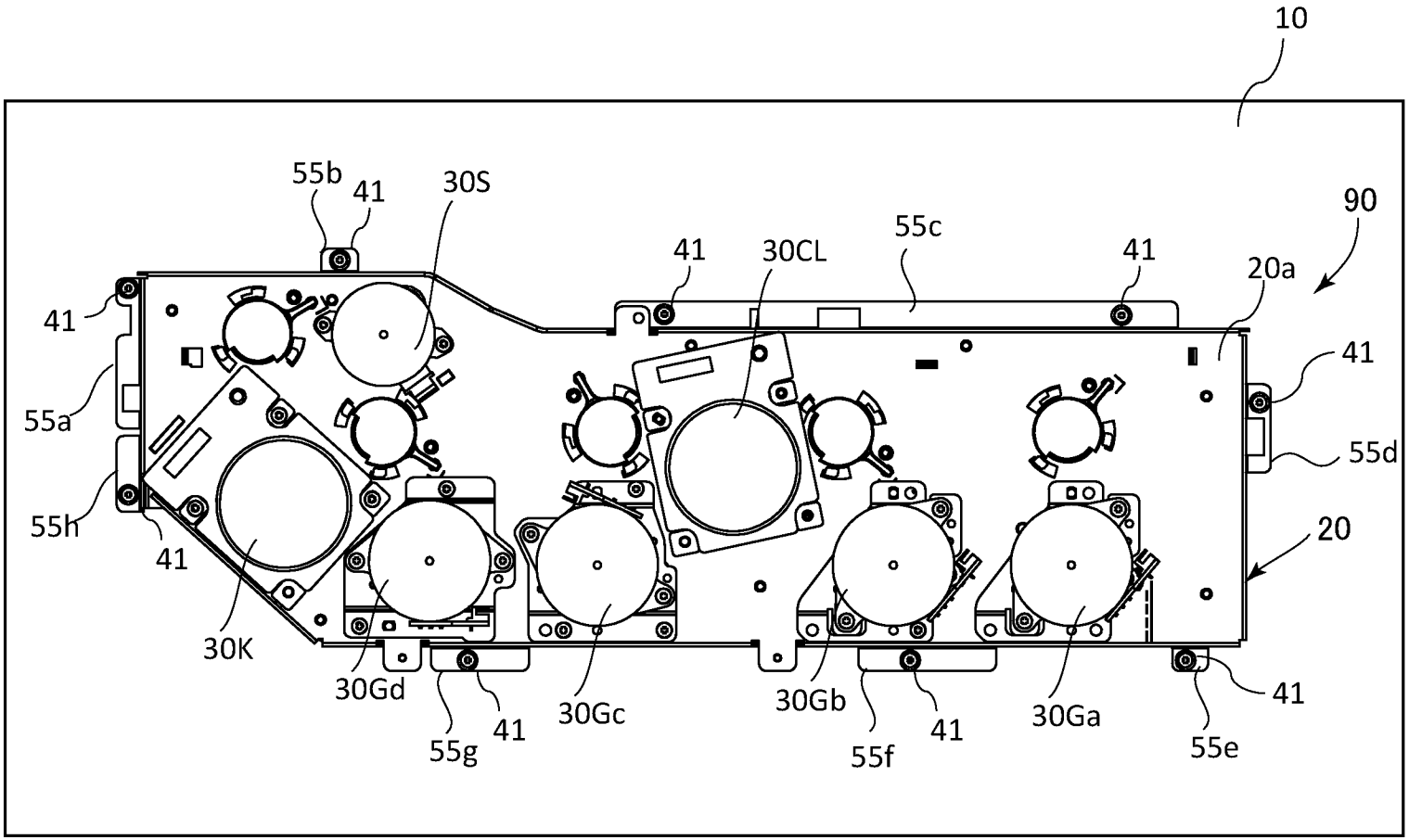
FIG. 3 is a view of the driving unit as viewed from a main support member side.

As illustrated in FIGS. 2 and 3, the driving unit 90 is attached to rear plate 10 of the support frame member 101A (see FIG. 1). The driving unit 90 is fixed to the rear plate 10 with screws 41 via a plurality of fixing portions 55*a* to 55*h* formed on the outer periphery of the main support member 20 with the sub support member 25 facing the rear plate 10. Attachment holes for attaching the screws 41 for fastening the main body are formed in the fixing portions 55*a* to 55*h*.

In the main support member 20, as illustrated in FIG. 2, an outer peripheral wall 15 is provided upright toward the rear plate 10 so as to surround the outer periphery so that foreign matter such as dust does not enter from the outside into the driving unit 90 in which the drive gear (see FIG. 4) is disposed. The fixing portions 55*a* to 55*h* described above are formed by being bent in an L shape with respect to the wall surface of the outer peripheral wall 15 so that a leading edge of the outer peripheral wall 15 comes into contact with the rear plate 10 and can be fixed to the rear plate 10 by the screws 41. That is, the fixing portions 55*a* to 55*h* are flange portions of the main support member 20. When it is difficult to continuously provide the outer peripheral wall 15 due to the processing of the sheet metal and an opening is formed, the opening may be closed with a sheet material or the like.

As illustrated in FIGS. 2 and 3, a plurality of motors 30CL, 30K, 30S, and 30Ga to 30Gd are held on one surface side of the main support member 20 as a driving source for driving the rotating member rotatably supported by the rear plate 10. Here, one motor 30CL for driving the yellow, magenta, and cyan photosensitive drums 112Y, 112M, and 112C, and one motor 30K for driving the black photosensitive drum 112K and the secondary transfer inner roller 116*a* are held. In addition, one motor 30S for driving the primary transfer roller separation mechanism (not illustrated) described above, and four motors 30Ga, 30Gb, 30Gc, and 30Gd for individually driving the yellow, magenta, cyan, and black developing units 114 (specifically, the developing sleeve 114*a*) are held.

Figure 4:
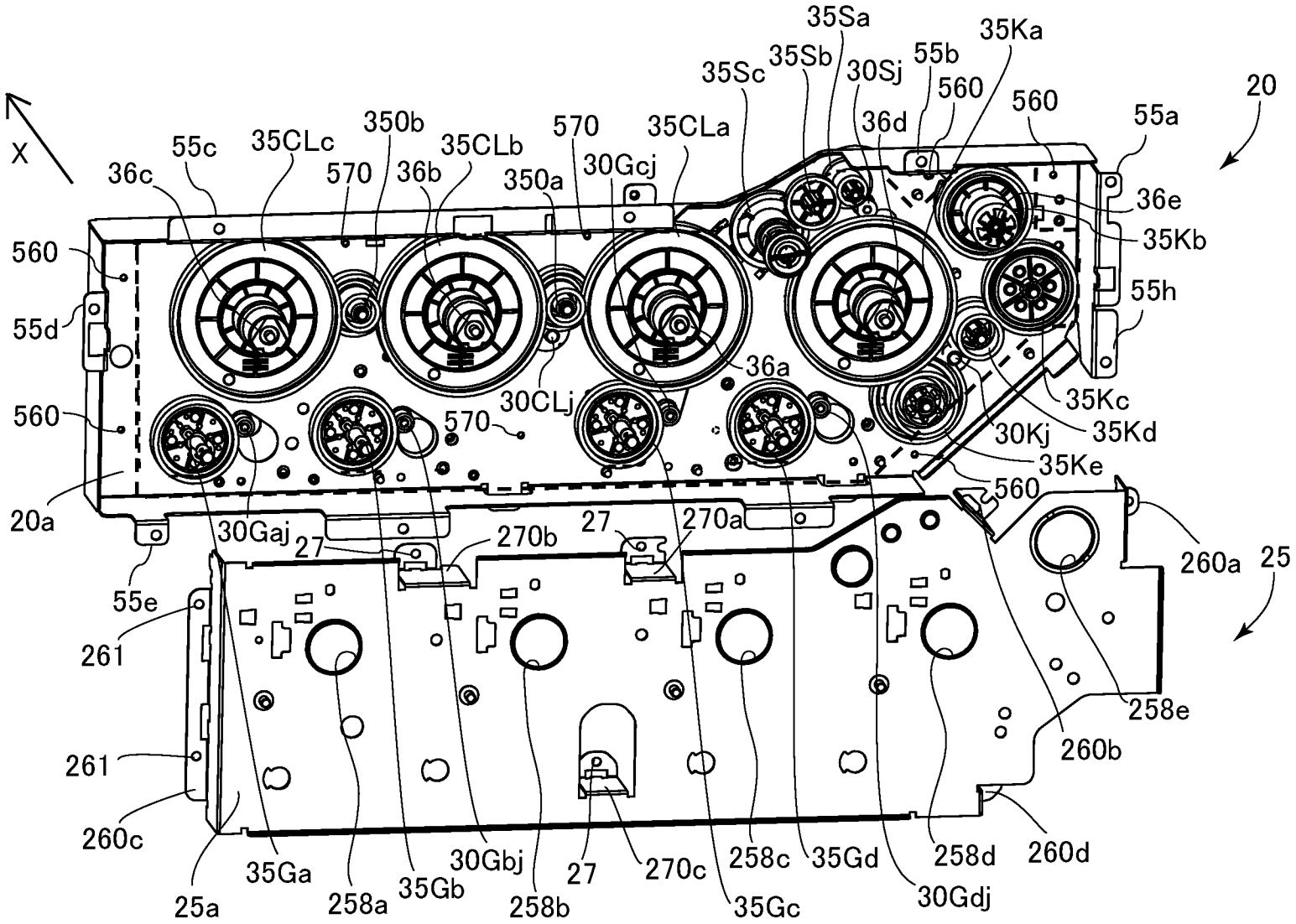
FIG. 4 is an exploded perspective view illustrating the driving unit.

On the other hand, as illustrated in FIG. 4, drive gears 35CLa to 35CLc, 35Ka to 35Ke, 35Sa to 35Sc, and 35Ga to 35Gd that transmit the driving force of the motors 30CL, 30K, 30S, and 30Ga to 30Gd (see FIG. 3) to the rotating member of the support frame member 101A are provided on other surface of the main support member 20 opposite to the one surface.

The drive gear 35Cla and the drive gear 35CLb are rotated by driving of the motor 30CL transmitted by the gear 350*a* that engages with the rotation shaft 30CLj of the motor 30CL and rotates. On the other hand, the drive gear 35CLc is engaged with the gear 350*b* engaged with the drive gear 35CLb, and is rotated by the drive of the motor 30CL transmitted via the drive gear 35CLb and the gear 350*b*.

In addition, the drive gear 35Ka is engaged with the drive gear 35Ke that rotates by being engaged with a drive shaft 30Kj of the motor 30K, and rotates by the drive of the motor 30K transmitted via the drive gear 35Ke. The drive gear 35Kb is rotated by driving of the motor 30K transmitted through the drive gear 35Kd engaged with the drive shaft 30Kj of the motor 30K and the drive gear 35Kc engaged with the drive gear 35Kd.

Further, the drive gear 35Sc rotates by driving of the motor 30S transmitted via the drive gear 35Sa engaged with the rotation shaft 30Sj of the motor 30S and the drive gear 35Sb engaged with the drive gear 35Sa.

The drive gear 35Ga directly engages with the rotation shaft 30Gaj of the motor 30Ga, so that the drive of the motor 30Ga is transmitted and the drive gear 35Ga rotates. The drive gear 35Gb directly engages with the rotation shaft 30Gbj of the motor 30Gb, so that the drive of the motor 30Gb is transmitted and the drive gear 35Gb rotates. The drive gear 35Gc directly engages with the rotation shaft 30Gcj of the motor 30Gc, so that the drive of the motor 30Gc is transmitted and the drive gear 35Gc rotates. The drive gear 35Gd directly engages with the rotation shaft 30Gdj of the motor 30Gd, so that the drive of the motor 30Gd is transmitted and the drive gear 35Gd rotates.

Then, the drive gears 35CLa to 35CLc transmit the driving force of the motor 30CL to the yellow, magenta, and cyan photosensitive drums 112Y, 112M, and 112C. More specifically, the drive gear 35CLa transmits the driving force to the cyan photosensitive drum 112C, the drive gear 35CLb transmits the driving force to the magenta photosensitive drum 112M, and the drive gear 35CLc transmits the driving force to the yellow photosensitive drum 112Y. The drive gears 35Ka and 35Ke transmit the driving force of the motor 30K to the black photosensitive drum 112K. The drive gears 35Kb to 35Kd transmit the driving force of the motor 30K to the secondary transfer inner roller 216*a*. Further, the drive gears 35Sa to 35Sc are provided to transmit the driving force of the motor 30S to the primary transfer roller separating mechanism (not illustrated), and the drive gears 35Ga to 35Gd are provided to transmit the driving force of the four motors 30Ga to 30Gd to the yellow, magenta, cyan, and black developing units 114 (specifically, the developing sleeve 114*a*). Viscous grease is applied to gear tooth surfaces of these drive gears 35CLa to 35CLc, 35Ka to 35Ke, 35Sa to 35Sc, and 35Ga to 35Gd in order to secure lubricity or quietness during rotation.

The drive gears 35CLa to 35CLc include couplings 36*a* to 36*d* that transmit driving to the yellow, magenta, and cyan photosensitive drums 112Y to 112C. The drive gear 35Ka includes a coupling 36*d* that transmits driving to the black photosensitive drum 112K, and the drive gear 35Kb includes a coupling 36*e* that transmits driving to the secondary transfer inner roller 216*a*. These couplings are respectively exposed from through holes 258*a* to 258*e* provided in a second support portion 25*a* of the sub support member 25, and can transmit driving force to the respective units. On the other hand, the drive gears 35CLa to 35CLc and the drive gears 35Ka to 35Ke are disposed in a space surrounded by the main support member 20 and the sub support member 25 for portions having tooth surfaces for transmitting drive. The drive gears 35Ga to 35Gd are disposed in a space (that is, in a drive gear storage space formed by the main support member 20 and the sub support member 25) covered by the main support member 20 and the sub support member 25, and are configured to transmit the driving force to the four developing units 114 by providing other gear to which the driving force is transmitted from the drive gears 35Ga to 35Gd and a coupling to which the driving force is transmitted from the other gear outside the sub support member 25. These couplings protrude from through holes provided in the rear plate 10 of the support frame member 101A to the inside of the support frame member 101A, so that driving force can be transmitted to the units supported by the support frame member 101A.

The main support member 20 and the sub support member 25 are arranged at both ends of the drive gears 35CLa to 35CLc, 35Ka to 35Ke, 35Sa to 35Sc, and 35Ga to 35Gd in the rotation axis direction, and each rotatably supports the rotation shaft of the drive gear. The main support member 20 includes a first support portion 20*a* that supports one end portion of the rotation shaft of the drive gear, and the sub support member 25 includes the second support portion 25*a* that supports another end portion of the rotation shaft of the drive gear. Note that the first support portion 20*a* may be configured to support a portion on one end side of the portion where the teeth of the drive gear are formed, and the second support portion 25*a* may be configured to support a portion on the other end side of the portion where the teeth of the drive gear are formed. As described above, the drive gears 35CLa to 35CLc and 35Ka of the photosensitive drums 112Y, 112M, 112C, and 112K of the four colors of yellow, magenta, cyan, and black are supported by the main support member 20 and the sub support member 25. With this configuration, the interaxial distances of the photosensitive drums 112Y, 112M, 112C, and 112K of the respective colors are less likely to deviate. Therefore, it is possible to suppress the occurrence of color shift when the image formed on each photosensitive drum is superimposed on the intermediate transfer belt 116. In the present embodiment, any one of the photosensitive drums 112Y, 112M, 112C, and 112K constitutes a first photosensitive drum, and any one of the remaining photosensitive drums constitutes a second photosensitive drum. In addition, the developing sleeve 114*a* corresponding to the first photosensitive drum constitutes a first developing sleeve, and the developing sleeve 114*a* corresponding to the second photosensitive drum constitutes a second developing sleeve.

In the present embodiment, the surfaces of the first support portion 20*a* and the second support portion 25*a* that support the drive gears 35CLa to 35CLc, 35Ka to 35Ke, 35Sa to 35Sc, and 35Ga to 35Gd are the same plane, but one or both of the first support portion 20*a* and the second support portion 25*a* may have irregularities, steps, or the like.

The main support member 20 and the sub support member 25 are arranged and connected so as to sandwich the drive gears 35CLa to 35CLc, 35Ka to 35Ke, 35Sa to 35Sc, and 35Ga to 35Gd. In the case of the present embodiment, the main support member 20 has a larger area than the sub support member 25, and has higher rigidity than the sub support member 25. Therefore, in the present embodiment, in order to connect the main support member 20 and the sub support member 25, the sub support member 25 is fastened to the main support member 20 by the screw 40 (see FIG. 5 to distinguish it from the screw 41 for fastening the main body) as a fastening member. The sub support member 25 is disposed upstream in the fastening direction (insertion direction, arrow X direction in FIG. 4) in which the screw 40 is fastened to the main support member 20.

In the main support member 20, an out-of-plane fastening hole 560 and an in-plane fastening hole 570 for fastening the screw 40 are formed in the first support portion 20*a*. On the other hand, the sub support member 25 is formed with out-of-plane mounting portions 260*a* to 260*d* and in-plane mounting portions 270*a* to 270*c* for inserting and attaching the screws 40. The out-of-plane fastening hole 560 and the in-plane fastening hole 570 of the main support member 20, the out-of-plane mounting portions 260*a* to 260*d* of the sub support member 25, and the in-plane mounting portions 270*a* to 270*c* will be described later (see FIGS. 5 and 6).

Metal Powder

Figure 7A:
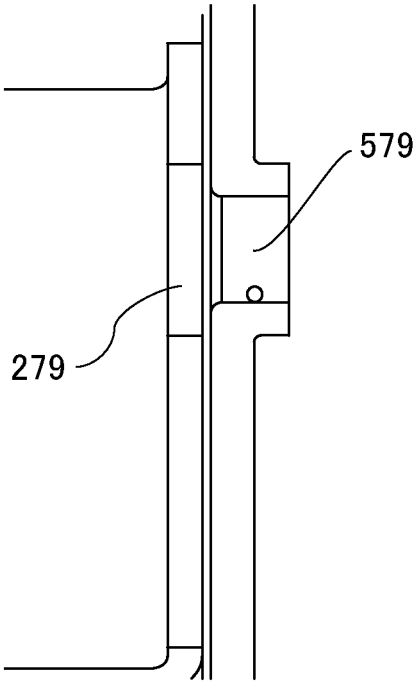
Figure 7B:
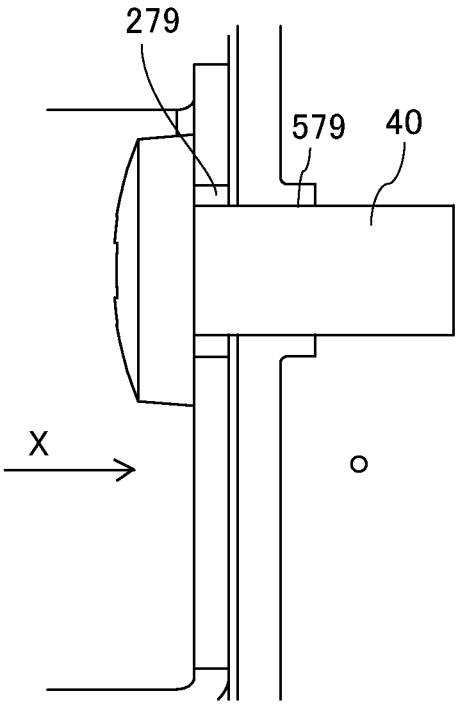

Incidentally, when the above-described members such as the main support member 20 and the sub support member 25 are connected using screws, metal powder (foreign matter) generated by fastening of the screws may fall into the driving unit. In a conventional driving unit, falling metal powder adheres to drive gears 35CLa to 35CLc, 35Ka to 35Ke, 35Sa to 35Sc, and 35Ga to 35Gd disposed in the driving unit, which causes image defects such as banding and abnormal noise from the drive gear. Here, the metal powder generated by the fastening of the screw will be described with reference to FIGS. 7A and 7B. FIG. 7A illustrates a state before the screw 40 is inserted into the fastening hole 579, and FIG. 7B illustrates a state after the screw 40 is inserted into the fastening hole 579.

In general, when members are fixed and connected by the screw 40, there are a case where the screw 40 is inserted into and fastened to the fastening hole 579 which is tapped in advance, and a case where the screw 40 itself is fastened while performing tapping. When the fastening hole 579 is tapped in advance, as illustrated in FIG. 7A, metal powder (for example, aluminum powder, iron powder, or the like) generated as scraping powder when tapping is performed may remain in the fastening hole 579. In this case, as illustrated in FIG. 7B, when the screw 40 is inserted into the fastening hole 579 formed in the other member via the attachment hole 279 formed in the one member, the metal powder remaining in the fastening hole 579 is pushed out from the fastening hole 579 by the screw 40 and falls downward in the gravity direction. On the other hand, when the screw 40 itself connects members while performing tapping, a part of metal powder generated as scraping powder when the tapping is performed is pushed out from the fastening hole 579 penetrated by the screw 40 and falls downward in the gravity direction. As described above, in any of the above cases, metal powder (foreign matter) may be generated in the fastening hole 579 when the screw 40 is fastened, and the metal powder is moved by the screw 40 to the downstream in the fastening direction (entry direction) in which the screw 40 is fastened and finally pushed out from the fastening hole 579.

Conventional Example

Figure 8A:
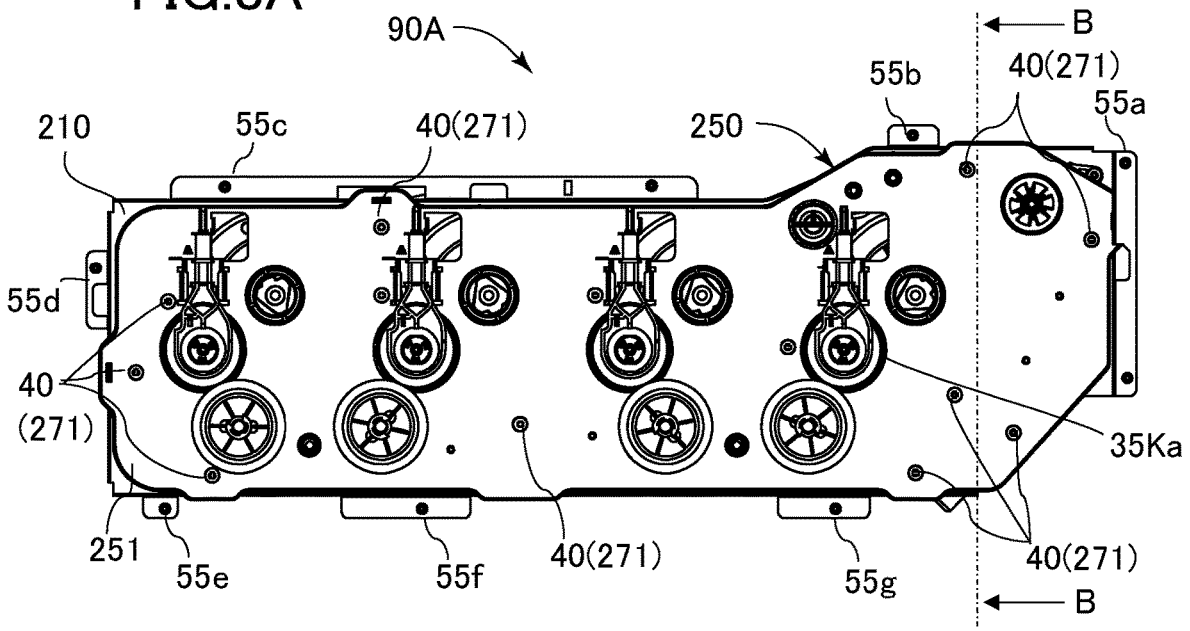
FIG. 8A is a view of a conventional driving unit as viewed from a sub support member side.
Figure 8B:
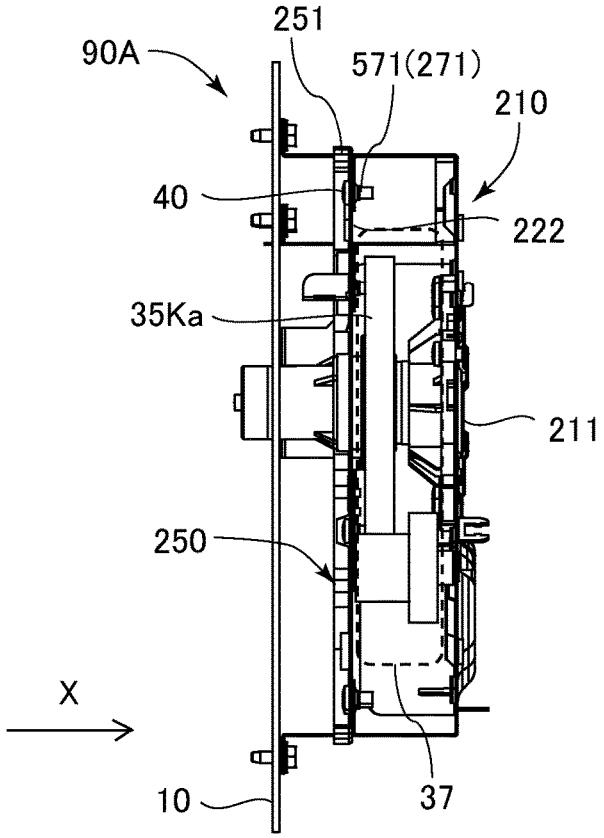
FIG. 8B is a cross-sectional view illustrating the conventional driving unit.

In the conventional driving unit, as described above, the metal powder pushed out from the fastening hole 579 as described above adheres to the drive gear, which causes image defects and abnormal noise. FIGS. 8A and 8B illustrate a conventional driving unit 90A. FIG. 8A is a view of the conventional driving unit 90A as viewed from the sub support member 250 side, and FIG. 8B is a cross-sectional view illustrating the conventional driving unit 90A.

As illustrated in FIG. 8A, in the case of the conventional driving unit 90A, a screw 40 for connecting the sub support member 250 to the main support member 210 is attached to the second support portion 251. In order to do so, an attachment hole 271 for attaching the screw 40 to the second support portion 251 is formed in the sub support member 250.

On the other hand, as shown in FIG. 8B, in the main support member 210, a mounting portion 222 is extended from the first support portion 211 toward the upstream in the fastening direction (direction of arrow X) of the screw 40 so as to come into contact with the second support portion 251. In the mounting portion 222, a fastening hole 571 for fastening the screw 40 is formed at a position overlapping the attachment hole 271 at a contact portion which is in contact with on the second support portion 251.

As can be understood from FIG. 8B, in the case of the conventional driving unit 90A, the distal end (specifically, the distal end of the screw portion) of the screw 40 protrudes from the downstream in the fastening direction of the fastening hole 571. This is because the downstream end in the fastening direction (fastening portion back side) of the fastening hole 571 is located at a position overlapping the drive gear (drive gear 35Ka as an example) arranged between the first support portion 211 and the second support portion 251 when viewed from the gravity direction, in a state where the main support member 210 and the sub support member 250 are connected.

Therefore, when the metal powder is pushed out from the fastening hole 571 by being moved to the downstream in the fastening direction due to the fastening by the screw 40, the metal powder falls onto the drive gear 35Ka and adheres to the gear tooth surface of the drive gear 35Ka. Then, when the drive gear 35Ka rotates and meshes, the metal powder is caught therein. Then, rotational fluctuation occurs in the drive gear 35Ka due to the metal powder, whereby rotational fluctuation also occurs in the black photosensitive drum 112K (see FIG. 2) driven via the drive gear 35Ka, and the like, and image defects and abnormal noise as described above occur.

Figure 9A:
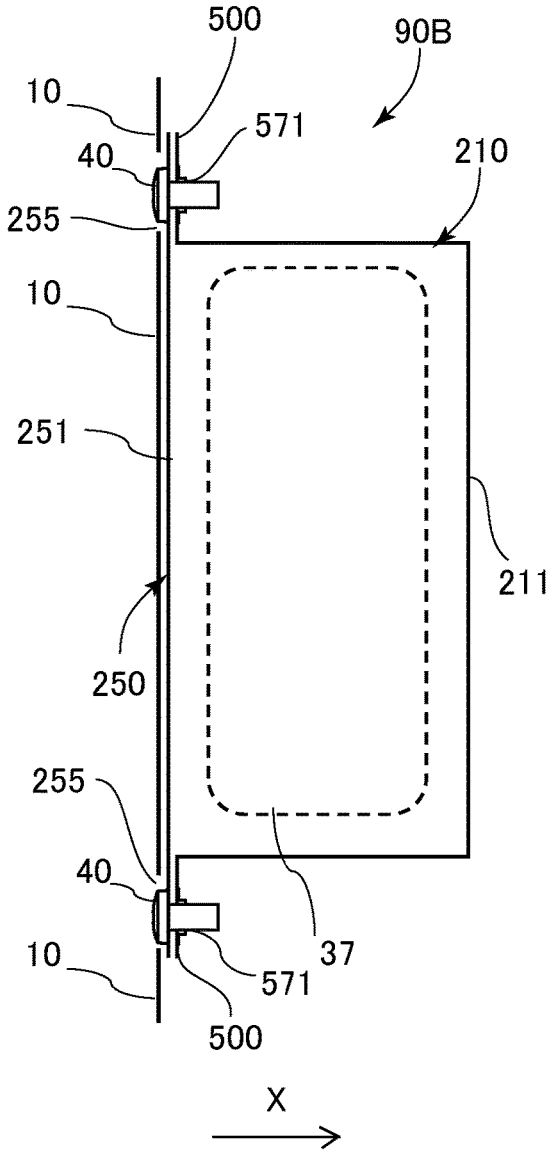
Figure 9B:
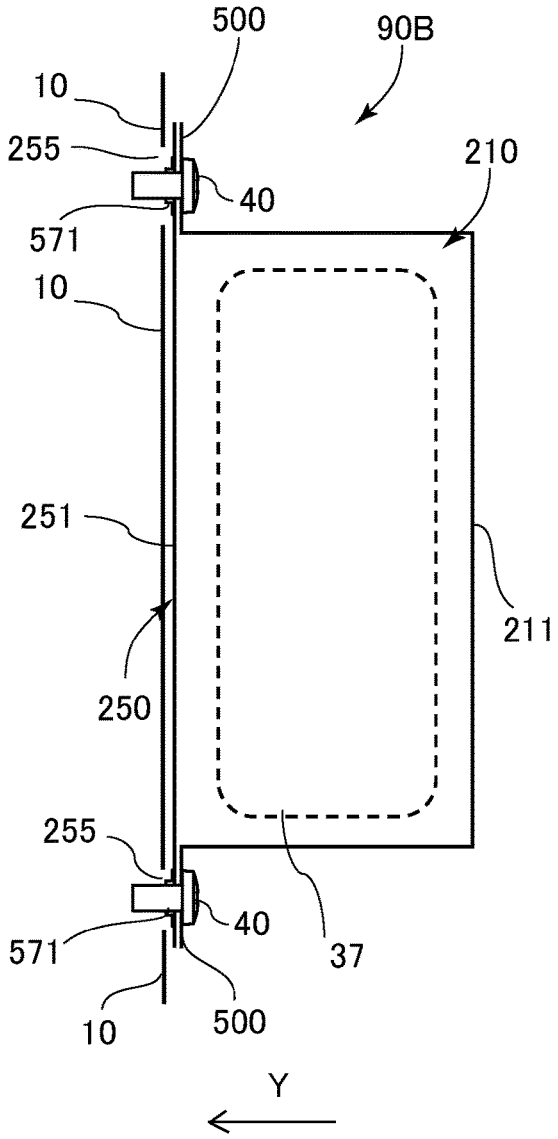

Therefore, it is conceivable to change the fastening position between the main support member 210 and the sub support member 250 so that the metal powder pushed out from the fastening hole 571 due to fastening of the screw 40 does not adhere to the drive gear. FIGS. 9A and 9B illustrate a driving unit 90B of a comparative example. In the driving unit 90B illustrated in FIGS. 9A and 9B, only the fastening direction (insertion direction) of the screw 40 is different, and the others are the same. FIG. 9A illustrates a case where the screw 40 is fastened from the sub support member 250 side toward the main support member 210 side (fastening direction is an arrow X direction), and FIG. 9B illustrates a case where the screw 40 is fastened from the main support member 210 side toward the sub support member 250 side (fastening direction is an arrow Y direction).

In the comparative example shown in FIGS. 9A and 9B, the main support member 210 and the sub support member 250 are connected by the screw 40 in such a manner that the sub support member 250 covers the main support member 210. In order to do so, the main support member 210 is formed with a fastening portion 500 bent outward at a position (outside the outer periphery of the first support portion 211) deviated from a projection plane of the second support portion 251 obtained by projecting the first support portion 211 in the rotation axis direction of the drive gear (not illustrated). In this case, even if the metal powder is pushed out from the fastening hole 571 due to the fastening by the screw 40, the metal powder does not enter the inside of the driving unit 90B and thus does not adhere to the drive gear.

However, in the case of the comparative example, since the fastening portion 500 is formed on the outer periphery of the main support member 210 in addition to the fixing portion 55 (see FIG. 2) for fixing the driving unit 90B to the rear plate 10, the size of the driving unit 90B increases. In order to avoid the screw 40 fastened to the fastening portion 500, it is necessary to form a retraction hole 255 for avoiding the screw 40 in the rear plate 10 in addition to a fastening hole for fastening the screw 41 attached via the fixing portion 55. That is, it is necessary to secure a space for forming the retraction hole 255 for avoiding the screw 40 in the rear plate 10 and to secure strength, so that the size of the driving unit 90B increases and the cost increases.

When a support member having the fastening hole is formed of a thin sheet metal, the fastening hole 571 is generally formed in a burring shape as illustrated in FIG. 7A. In this case, a sufficient distance must be taken from the fastening hole 571 to the bending position of the fastening portion 500 of the main support member 210. This is because, if the fastening hole 571 formed in the burring shape is close to the bending position, when the fastening portion 500 is formed to be bent, the fastening portion is pulled by bending, and the accuracy of the position is lowered. When it is desired to provide the fastening hole near the bending position, it is necessary to provide a hole called bending relief at the bending root. Therefore, if the fastening hole 571 is provided sufficiently away from the bending position, the size of the driving unit 90B increases, and if the fastening hole is provided close to the bending position, a hole is formed in the bending root, and metal powder generated due to fastening by the screw 40 can enter the driving unit 90B from the hole.

In order to prevent the metal powder from entering the inside of the driving unit 90B through the hole formed in the bending root, it is conceivable to fasten the screw 40 from the main support member 210 side toward the sub support member 250 side as illustrated in FIG. 9B. However, as in the case of FIG. 9A, in order to avoid the screw 40 fastened to the fastening portion 500, it is necessary to form the retraction hole 255 for avoiding the screw 40 in the rear plate 10, so that the size of the driving unit 90B increases and the cost may increase. Further, when an operator detaches the driving unit 90B, there is a possibility that the screw 40 connecting the main support member 210 and the sub support member 250 is erroneously detached instead of the screw 41 (see FIG. 3) attaching the driving unit 90B to the rear plate 10 via the fixing portion 55. That is, it is difficult for the operator to know which screw should be removed in order to remove the driving unit 90B from the rear plate 10, and workability at the time of maintenance is deteriorated.

Fastening Configuration in Present Embodiment

Next, a fastening configuration of the main support member 20 and the sub support member 25 by the screw 40 in the present embodiment in consideration of the problems of the conventional example and the comparative example described above will be described with reference to FIGS. 4 to 6.

Figure 5:
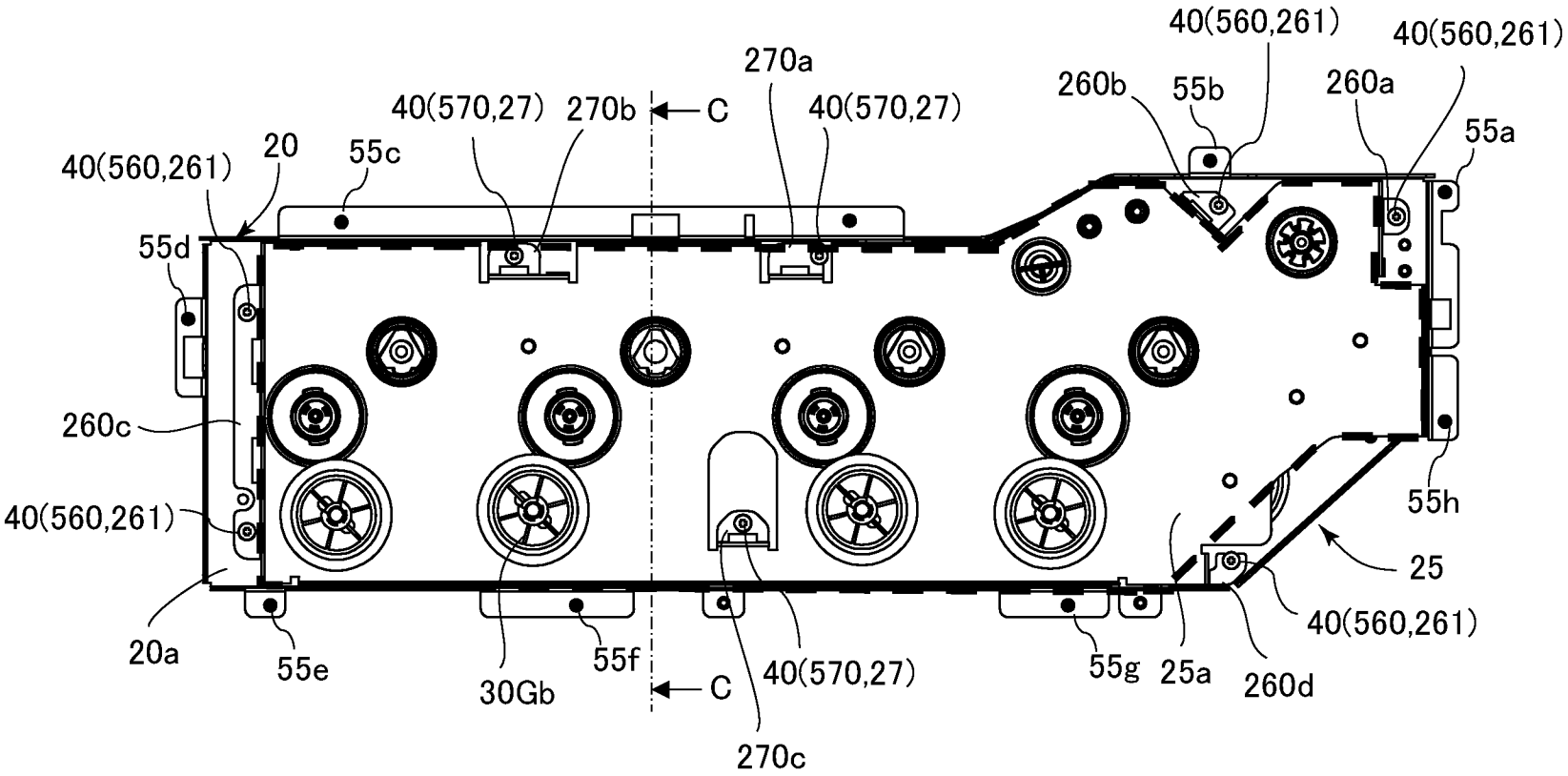
FIG. 5 is a view of the driving unit as viewed from a sub support member side.

As illustrated in FIG. 5, an in-plane fastening hole 570 for fastening the screw 40 is formed in the first support portion 20*a* of the main support member 20, and in-plane mounting portions 270*a* to 270*c* for inserting and attaching the screw 40 are formed in the sub support member 25. The in-plane fastening hole 570 of the main support member 20 is formed in a projection plane obtained by projecting the second support portion 25*a* of the sub support member 25 in the rotation axis direction of the drive gears 35CLa to 35CLc, 35Ka to 35Ke, 35Sa to 35Sc, and 35Ga to 35Gd (see FIG. 4) in the first support portion 20*a*. The projection plane of the second support portion 25*a* is a projection plane obtained by projecting an outer periphery represented by connecting outermost edges of a surface of the second support portion 25*a* supporting the drive gears 35CLa to 35CLc, 35Ka to 35Ke, 35Sa to 35Sc, and 35Ga to 35Gd, and is a region indicated by a broken line in FIGS. 4 and 5.

Figure 6:
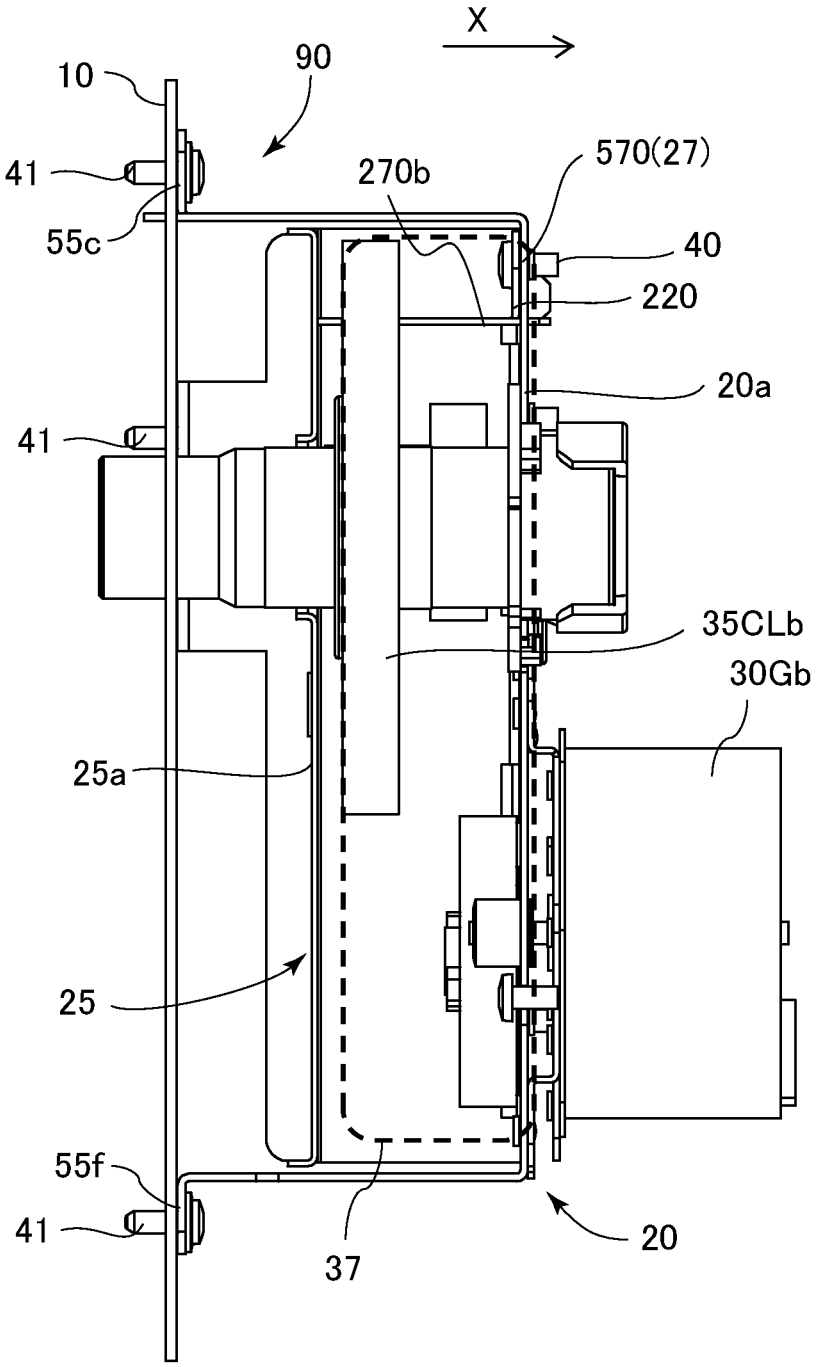
FIG. 6 is a cross-sectional view illustrating the driving unit.

On the other hand, as shown in FIG. 6, the in-plane mounting portion (here, representatively an in-plane mounting portion 270*b*) of sub support member 25 extends from second support portion 25*a* toward the downstream (first support portion 20*a* side) in the fastening direction of screw 40 so as to be in contact with the first support portion 20*a* in the projection plane. In the in-plane mounting portion 270*b*, an in-plane attachment hole 27 for inserting and attaching the screw 40 is formed at a position overlapping the in-plane fastening hole 570 of the main support member 20 at the contact portion 220 which is in contact with the first support portion 20*a*. As shown in FIG. 4, such in-plane mounting portions 270*a* to 270*c* are flange portions formed by cutting a part of the second support portion 25*a* and bending the second support portion toward the main support member 20 side (first support member side).

As shown in FIG. 6, the main support member 20 is fixed to the rear plate 10 (support frame) of the support frame body 101A (see FIG. 1) in a state where the sub support member 25 faces the rear plate 10. In a state where the main support member 20 and the sub support member 25 are connected, the distal end (specifically, the distal end of the screw portion) of the screw 40 protrudes from the downstream in the fastening direction of the in-plane fastening hole 570. However, in the case of the present embodiment, in a state where the main support member 20 and the sub support member 25 are connected, the downstream end in the fastening direction (fastening portion back side) of the in-plane fastening hole 570 is at a position not overlapping the space 37 sandwiched between the first support portion 20*a* and the second support portion 25*a* when viewed from the gravity direction. That is, the downstream end of the in-plane fastening hole is positioned outside the driving unit 90 so as not to overlap with each drive gear (for example, the drive gear 35CLb) arranged between the first support portion 20*a* and the second support portion 25*a*. Therefore, as described above, even if the metal powder is moved to the downstream in the fastening direction due to the fastening by the screw 40 and pushed out from the in-plane fastening hole 570, the metal powder does not fall on the drive gear 35CLb. Therefore, since the metal powder generated by the fastening by the screw 40 cannot adhere to the drive gear 35CLb, the image defect and the abnormal noise as described above do not occur. Further, in the case of the present embodiment, since it is not necessary to newly secure a space for bringing the main support member 20 in contact with the in-plane mounting portions 270*a* to 270*c* of the sub support member 25 in the gravity direction and fixing the main support member, the present embodiment can be realized without increasing the size of the driving unit 90.

In the case of the present embodiment, as illustrated in FIGS. 4 and 5, the main support member 20 is formed with the out-of-plane fastening hole 560 for fastening the screw 40 outside the projection plane of the first support portion 20*a*. On the other hand, in the sub support member 25, the out-of-plane mounting portions 260*a* to 260*d* are extended from second support portion 25*a* toward the downstream (first support portion 20*a* side) in the fastening direction of screw 40 so as to be in contact with first support portion 20*a* outside the projection plane. The out-of-plane mounting portions 260*a* to 260*d* are formed with an out-of-plane attachment hole 261 for inserting and attaching the screw 40. That is, in the present embodiment, in order to more firmly fix the sub support member 25 to the main support member 20, the sub support member can also be fixed by the out-of-plane mounting portions 260*a* to 260*d* provided at positions different from the in-plane mounting portions 270*a* to 270*c*. The out-of-plane mounting portions 260*a* to 260*d* and the in-plane mounting portions 270*a* to 270*c* are disposed inside the outer periphery of the first support portion 20*a* of the main support member 20 so as to be in contact with the first support portion 20*a*.

In the present embodiment, relative positioning between the main support member 20 and the sub support member 25 is performed by the in-plane mounting portions 270 provided at three positions, so that positional deviation generated at the time of fastening the screw 40 is suppressed. In the present embodiment, as an example, as illustrated in FIGS. 4 and 5, positioning in the left-right direction is performed at one position, and positioning in the up-down direction is performed at two positions. Note that the present invention is not limited thereto, and the in-plane mounting portions 270 may be formed at a total of two positions, that is, one position for positioning up, down, left, and right and one position for rotation stop. Further, if the sub support member 25 can be firmly fixed to the main support member 20, an in-plane mounting portion 270 may be further provided instead of the out-of-plane mounting portions 260*a* to 260*d*. In such a case, since it is not necessary to newly secure a space for fixing the sub support member 25 in the width direction intersecting the gravity direction in the main support member 20, the driving unit 90 can be further downsized.

As shown in FIG. 6, since the back side of the fastening portion of the fixing portion 55 for fixing to the rear plate 10 is located on the opposite side of the driving unit 90 in the rear plate 10, metal powder generated due to fastening by the screw 41 does not adhere to the drive gear.

As described above, in the present embodiment, the in-plane mounting portions 270*a* to 270*c* extending from the sub support member 25 are brought into contact with the main support member 20, and are fastened by the screws 40 from the sub support member 25 side toward the main support member 20 side. In this case, as described above, since the downstream end in the fastening direction (fastening portion back side) of the in-plane fastening hole 570 is located outside the driving unit 90, metal powder generated due to fastening by the screw 40 cannot adhere to the drive gear, and image defects and abnormal noise as described above do not occur.

Other Embodiments

In the embodiment described above, the intermediate transfer image forming apparatus 101 in which a toner image is primarily transferred from the photosensitive drums 112Y to 112K of the respective colors to the intermediate transfer belt 116, and then the toner image is secondarily transferred from the intermediate transfer belt 116 to the recording material S has been described as an example, but the present invention is not limited thereto. The above-described embodiment can also be applied to a direct transfer type image forming apparatus that directly transfers a toner image from the photosensitive drums 112Y to 112K of the respective colors that carry the toner image and rotate to the recording material S.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-073856, filed Apr. 26, 2021 and Japanese Patent Application No. 2022-036137, filed Mar. 9, 2022, which are hereby incorporated by reference herein in their entirety.

What is claimed is:

1. An image forming apparatus that forms an image on a recording material, the image forming apparatus comprising:

a rotating member; and a driving unit configured to drive the rotating member, wherein the driving unit includes a driving source, a drive gear configured to transmit a driving force of the driving source to the rotating member, a first support member that holds the driving source and includes a first support portion that supports one end portion of a rotation shaft of the drive gear in a rotation axis direction of the drive gear, and a second support member that includes a second support portion that supports another end portion of the rotation shaft and is connected to the first support member by a fastening member, wherein the first support member includes a fastening hole to which the fastening member is fastened, the fastening hole being disposed in a projection plane obtained by projecting the second support portion in the rotation axis direction of the drive gear, and wherein the second support member is disposed upstream of the first support member in a fastening direction in which the fastening member is fastened, and includes a mounting portion extending from the second support portion downstream in the fastening direction so as to be in contact with the first support portion in the projection plane, the mounting portion including an attachment hole into which the fastening member is inserted, the attachment hole being disposed at a position overlapping the fastening hole in a contact portion of the mounting portion which is in contact with the first support portion.

2. The image forming apparatus according to claim 1, wherein the mounting portion is formed by cutting a part of the second support portion and bending the part of the second support portion toward the first support member.

3. The image forming apparatus according to claim 1, further comprising a support frame that supports the rotating member, wherein the first support member is fixed to the support frame in a state where the second support member faces the support frame.

4. The image forming apparatus according to claim 1, wherein the first support member has higher rigidity than the second support member.

5. The image forming apparatus according to claim 1, wherein the first support member includes another fastening hole that is disposed outside the projection plane and to which a fastening member is fastened, and the second support member includes another mounting portion extending from the second support member downstream in the fastening direction so as to be in contact with the first support portion outside the projection plane, the another mounting portion including another attachment hole to which the fastening member is fastened, the another attachment hole being disposed at a position overlapping another fastening hole of the first support member.

6. The image forming apparatus according to claim 1, further comprising a plurality of rotating members including the rotating member, wherein the driving source is configured to drive the plurality of the rotating members via the drive gear.

7. The image forming apparatus according to claim 1, wherein the rotating member includes a photosensitive drum configured to rotate while carrying a toner image.

8. The image forming apparatus according to claim 1, wherein the rotating member includes a developing sleeve configured to carry toner and rotate to develop a toner image on a photosensitive drum.

9. The image forming apparatus according to claim 1, wherein the rotating member includes a secondary transfer roller that forms a nip portion for secondarily transferring a toner image onto a recording material from an intermediate transfer belt to which the toner image formed on a photosensitive drum has been primarily transferred.

10. The image forming apparatus according to claim 1, wherein the rotating member includes a first photosensitive drum configured to carry a toner image and rotate, and the drive gear includes a coupling that transmits a driving force from the driving source to the first photosensitive drum, the image forming apparatus further comprising:

a first developing sleeve configured to develop an electrostatic latent image formed on the first photosensitive drum using toner;

a second photosensitive drum different from the first photosensitive drum;

a second developing sleeve configured to develop an electrostatic latent image formed on the second photosensitive drum using toner having a color different from that of the first developing sleeve; and another drive gear including a coupling that transmits a driving force from the driving source to the second photosensitive drum, wherein another drive gear is supported by the first support member and the second support member.

11. The image forming apparatus according to claim 1, wherein the rotating member includes a first photosensitive drum configured to carry a toner image and rotate, and the drive gear includes a coupling that transmits a driving force from the driving source to the first photosensitive drum, the image forming apparatus further comprising:

a first developing sleeve configured to develop an electrostatic latent image formed on the first photosensitive drum using toner;

a second photosensitive drum different from the first photosensitive drum;

a second developing sleeve configured to develop an electrostatic latent image formed on the second photosensitive drum using toner having a color different from that of the first developing sleeve;

another driving source different from the driving source; and another drive gear including a coupling that transmits a driving force from another driving source to the second photosensitive drum, wherein another drive gear is supported by the first support member and the second support member.

12. The image forming apparatus according to claim 1, wherein the driving source is fixed outside a drive gear housing space formed by the first support member and the second support member.

13. An image forming apparatus that forms an image on a recording material, the image forming apparatus comprising:

a rotating member; and a driving unit configured to drive the rotating member, wherein the driving unit includes:

a driving source;

a drive gear configured to transmit a driving force of the driving source to the rotating member;

a first support member that holds the driving source and includes a first support portion that supports one end portion of a rotation shaft of the drive gear in a rotation axis direction of the drive gear; and a second support member that includes a second support portion that supports another end portion of the rotation shaft and is connected to the first support member by a fastening member, wherein the first support member includes a fastening hole to which the fastening member is fastened and that is disposed in a projection plane obtained by projecting the second support portion in the rotation axis direction of the drive gear, and wherein the second support member is disposed upstream of the first support member in a fastening direction in which the fastening member is fastened, and includes a flange portion extending from the second support portion downstream in the fastening direction in the projection plane, the flange portion including an attachment hole into which the fastening member is inserted, the attachment hole being disposed at a position overlapping the fastening hole.

* * * * *